US009789982B2

(12) United States Patent
Corniani et al.

(10) Patent No.: US 9,789,982 B2
(45) Date of Patent: Oct. 17, 2017

(54) DEVICE FOR SUPPORTING CONTAINERS IN FILLING MACHINES FOR PRODUCTS IN POWDER FORM OR THE LIKE

(71) Applicant: WEIGHTPACK S.P.A., Goito (IT)

(72) Inventors: Carlo Corniani, Marmirolo (IT); Antonio Franco Selmo, San Bonifacio (IT)

(73) Assignee: WEIGHTPACK S.R.L., Goito (IT)

( * ) Notice: Subject to any disclaimer, the term of this patent is extended or adjusted under 35 U.S.C. 154(b) by 0 days.

(21) Appl. No.: 14/437,716

(22) PCT Filed: Oct. 11, 2013

(86) PCT No.: PCT/EP2013/071256
§ 371 (c)(1),
(2) Date: Apr. 22, 2015

(87) PCT Pub. No.: WO2014/063930
PCT Pub. Date: May 1, 2014

(65) Prior Publication Data

US 2015/0291293 A1 Oct. 15, 2015

(30) Foreign Application Priority Data

Oct. 25, 2012 (IT) ..... VR2012A0210

(51) Int. Cl.
*B65B 1/22* (2006.01)
*B65B 43/62* (2006.01)
*B65B 1/32* (2006.01)

(52) U.S. Cl.
CPC ..... *B65B 1/22* (2013.01); *B65B 43/62* (2013.01); *B65B 1/32* (2013.01)

(58) Field of Classification Search
CPC ..... B65B 1/22; B65B 1/32; B65B 43/62
(Continued)

(56) References Cited

U.S. PATENT DOCUMENTS 3,840,789 A * 10/1974 Dion ..... H02K 33/10 250/232
4,084,626 A * 4/1978 King ..... B65B 1/32 141/172

(Continued)

FOREIGN PATENT DOCUMENTS

DE 946334 C 7/1956
DE 947958 C 8/1956

OTHER PUBLICATIONS

International Search Report and Written Opinion re: Application No. PCT/EP2013/071256 filed Oct. 11, 2013; dated Dec. 6, 2013.

*Primary Examiner* — Timothy L Maust
*Assistant Examiner* — Andrew Schmid
(74) *Attorney, Agent, or Firm* — Cantor Colburn LLP

(57) ABSTRACT

A device for supporting containers in filling machines for products in powder form includes, a first supporting element, connected to the structure of a filling machine, and a second supporting element designed to support a respective container to be filled. The device further includes actuation elements configured for actuating, with a vibrating motion, the second supporting element with respect to the first supporting element. The second supporting element can rotate with respect to the first supporting element about a substantially vertical rotation axis. The actuation elements further include elements for generating a variable magnetic field, which are integral with one of the supporting elements, and magnetic means, which are integral with the other of the supporting elements and interact with the generator to cause an alternating oscillation, in the two opposite rotation directions, of the second supporting element with respect to the first supporting element, about the rotation axis.

11 Claims, 9 Drawing Sheets

(58) Field of Classification Search
USPC ..... 141/79, 165
See application file for complete search history.

(56) References Cited

U.S. PATENT DOCUMENTS 4,437,985 A * 3/1984 Hinds ..... B07C 5/3404
198/346.2
4,465,111 A * 8/1984 Nalbach ..... B65B 1/22
141/165
5,058,724 A * 10/1991 Hinton ..... B65C 9/067
198/376

* cited by examiner

DEVICE FOR SUPPORTING CONTAINERS IN FILLING MACHINES FOR PRODUCTS IN POWDER FORM OR THE LIKE

FIELD

The present disclosure relates to a device for supporting containers in filling machines for products in powder form or the like.

BACKGROUND

As is known, filling machines for products in the form of powder or granules or other similar products have a fixed structure that supports a conveyor of containers, constituted typically by a rotating carousel, which supports a plurality of supporting devices on which the containers to be filled are arranged.

Above each one of these supporting devices there is a respective head for dispensing the product, which is caused to fall onto the underlying container so as to fill it progressively.

In some filling machines, known as weight-filling machines, the container supporting devices are connected to the remaining structure of the machine by the interposition of load cells, designed to supply a signal that is proportional to the weight of the product poured into the containers, so as to allow the determination, by means of appropriate control systems, that the weight of the desired product inside the containers has been reached.

One drawback of this type of machine resides in the fact that the product that falls into the container tends not to distribute uniformly inside it but rather to accumulate in the region where it falls into the container, with the risk of reaching and rising above the upper rim of the container long before all of the product has been spilled into said container.

For solving this drawback, devices for supporting containers have been proposed which are provided with actuation means that are capable of vibrating the containers during their filling process so as to obtain a more uniform filling of the containers with the dispensed product.

Currently known supporting devices of this type operate by means of vibrating motions that have a radial direction with respect to the rotation axis of the carousel thanks to the operation of mechanical elements provided with a system of antagonist elastic elements.

These devices, besides not ensuring the same reliability over time, due to the loss of the mechanical characteristics of the elastic elements, do not allow an easy variation of the vibration frequency.

Moreover, the vibrating motions induced in known supporting devices tend to influence the response of the load cells associated therewith, with consequent distortion of the signal that arrives from said load cells due to the addition of force components that alter the information relating to weight.

SUMMARY

The aim of the present disclosure is to provide a solution to the drawbacks of the background art, providing a device for supporting containers in filling machines for products in powder form or the like that is capable of achieving a perfect distribution of the product that is spilled into the containers.

Within this aim, an object of the disclosure is to provide a device for supporting containers that is highly reliable over time.

Another object of the disclosure is to provide a supporting device that allows an easy variation of the vibration frequency.

Another object of the present disclosure is to provide a container supporting device that does not interfere with the correct operation of the load cells.

Another object of the present disclosure is to provide a device for supporting containers in filling machines for products in powder form or the like that can be obtained by means of commonly commercially available elements and materials and that furthermore has a highly competitive production cost.

BRIEF DESCRIPTION OF THE DRAWINGS

Further characteristics and advantages of the disclosure will become more apparent from the description of some preferred but not exclusive embodiments thereof, illustrated by way of non-limiting example in the accompanying drawings, wherein.

DETAILED DESCRIPTION OF THE DRAWINGS

Figure 1:
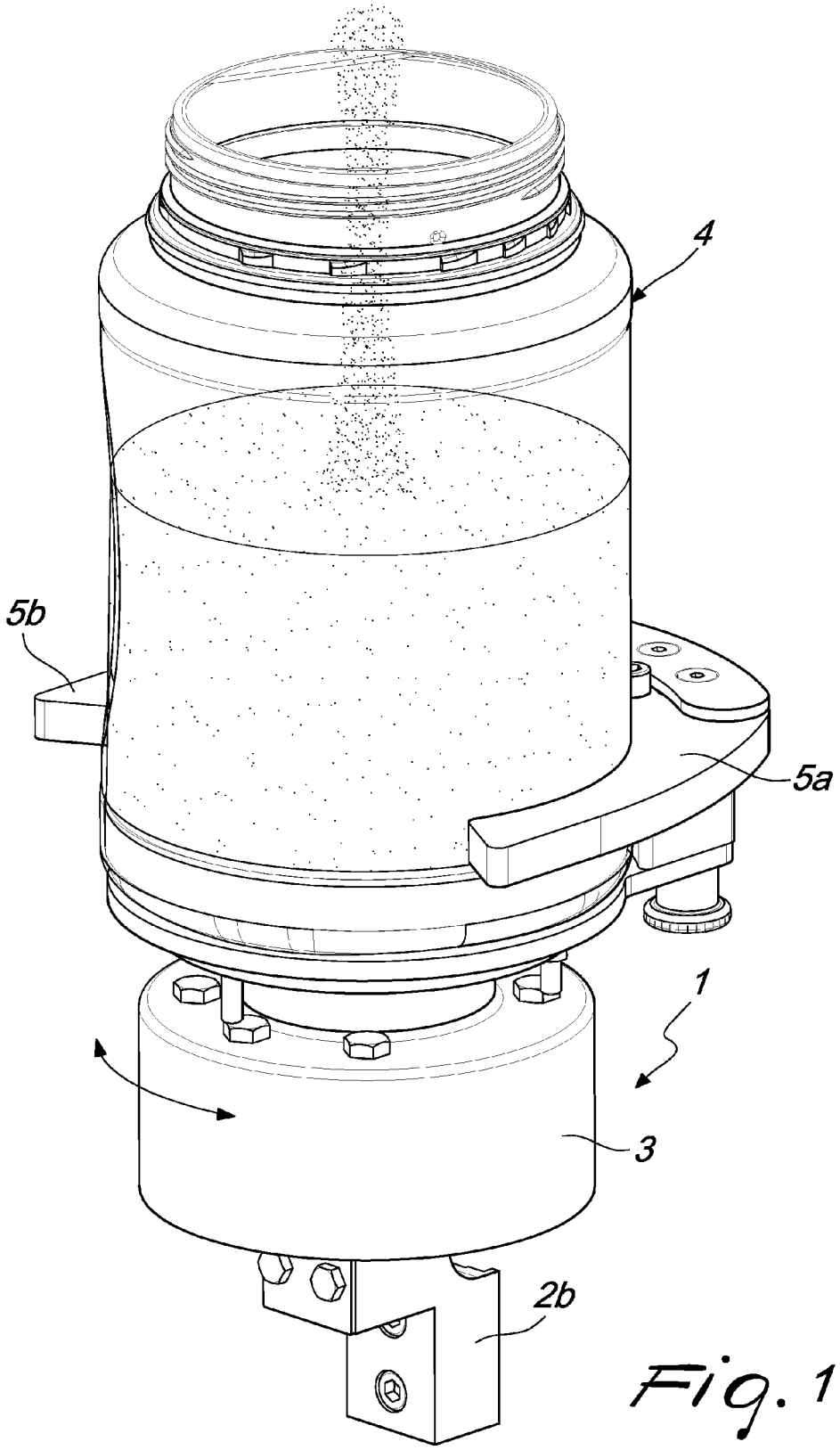
FIG. 1 is a perspective view of a device according to the disclosure, with a container rested thereon and being filled with a product in powder form on a filling machine.

With reference to the figures, the device for supporting containers in filling machines for products in powder form or the like, generally designated by the reference numeral 1, comprises at least two supporting elements 2 and 3, which are mutually coupled and are constituted in practice by a first supporting element 2, which is connected to the structure of a filling machine, and a second supporting element 3, which is instead mounted on the first supporting element 2 with the possibility of moving with respect to said first supporting element 2.

More particularly, the first supporting element 2 is designed to be connected integrally to a conveyance means of the filling machine, such as for example a carousel, by means of the interposition of a load cell, not shown.

Figure 2:
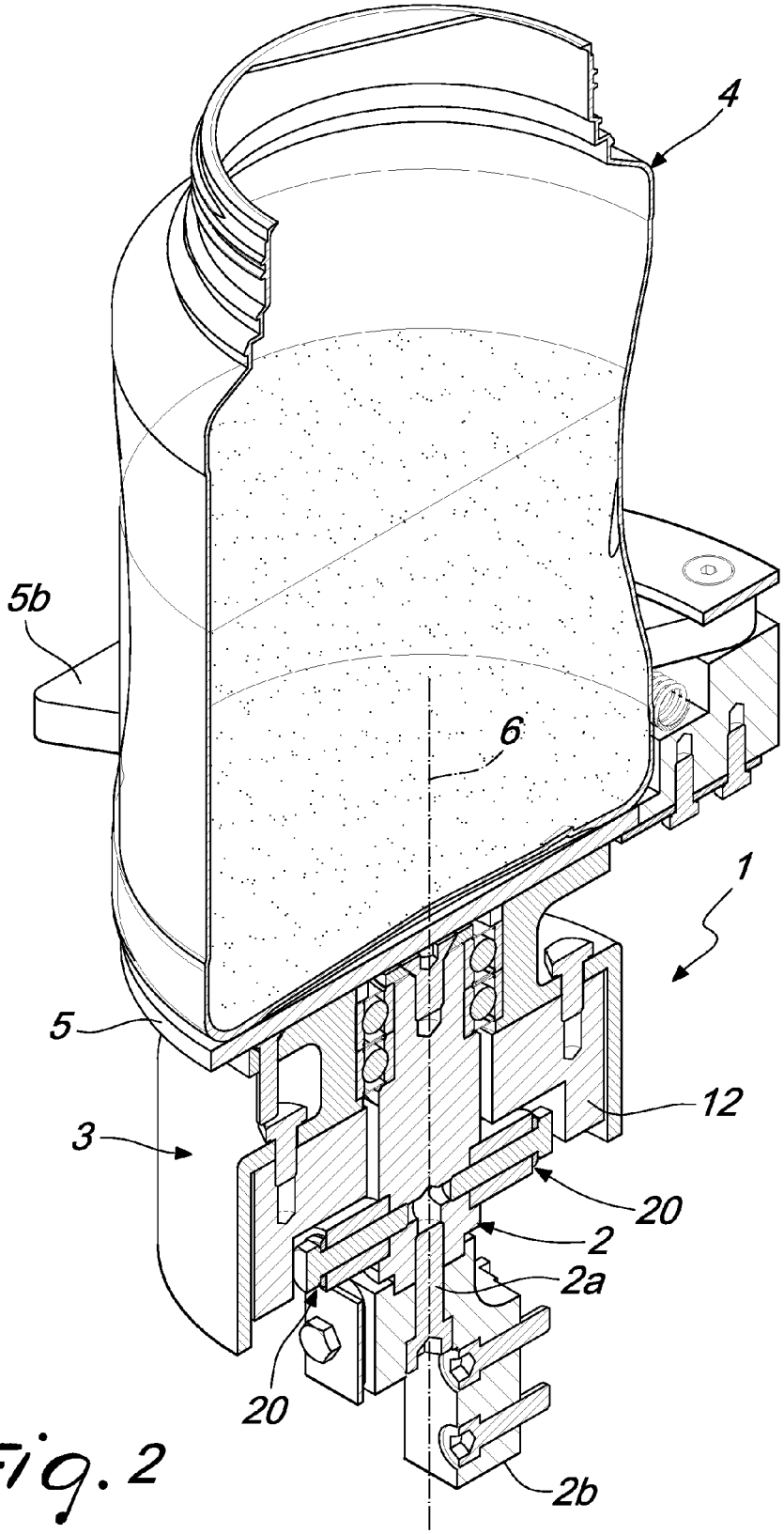
FIG. 2 is a sectional perspective view of the device according to the disclosure and of a container rested thereon.
Figure 4:
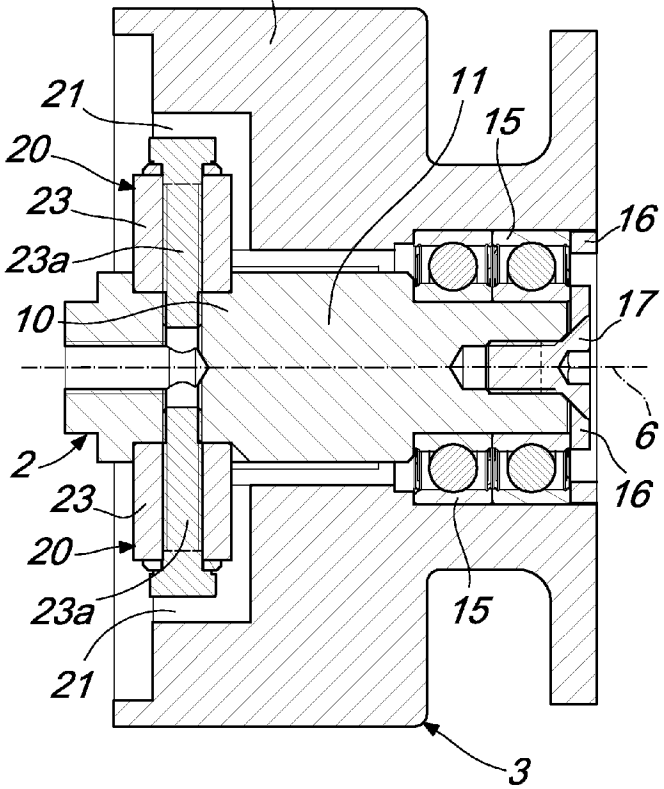
FIG. 4 is a sectional view, along the plane IV-IV of FIG. 3.
Figure 3:
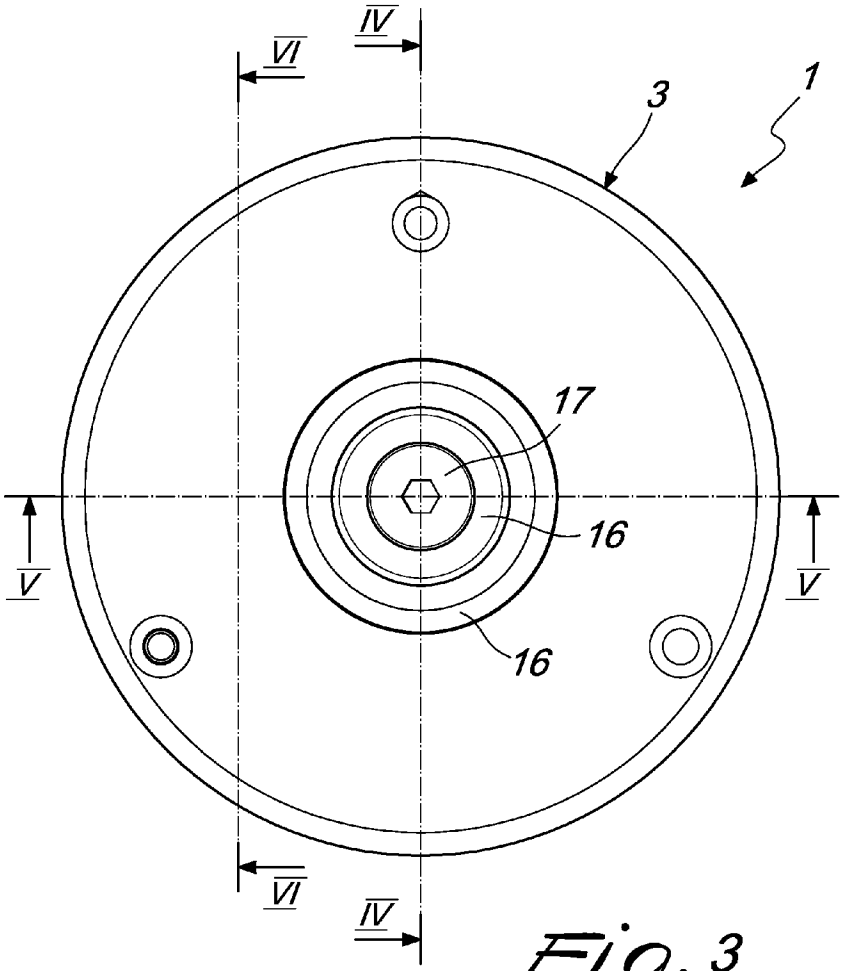
FIG. 3 is a top plan view of the device according to the disclosure.
Figure 5:
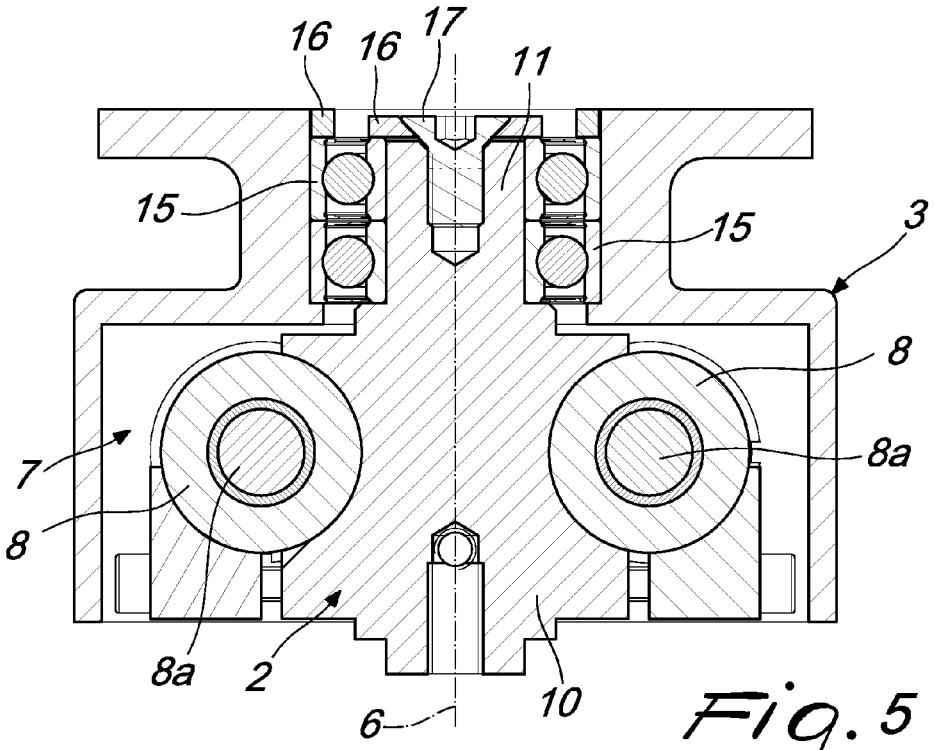
FIG. 5 is a sectional view, along the plane V-V of FIG. 3.
Figure 6:
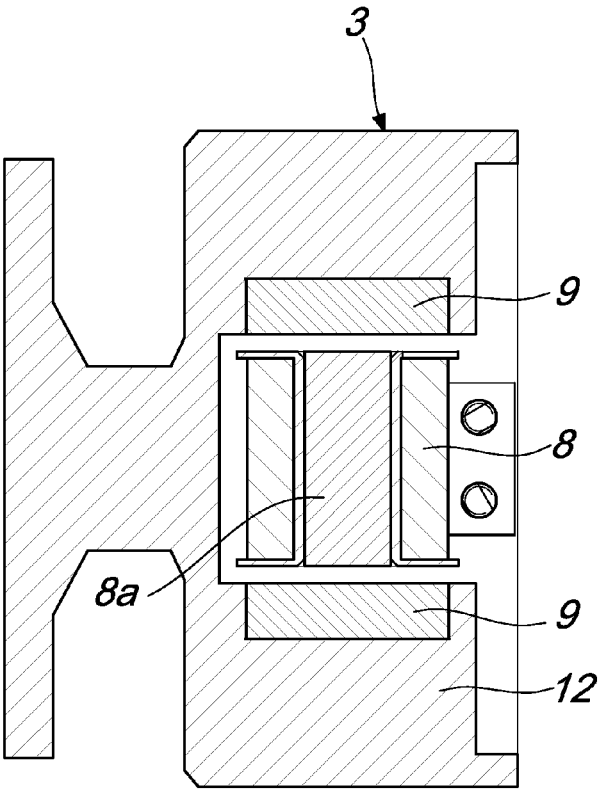
FIG. 6 is a sectional view, along the plane VI-VI of FIG. 3.
Figure 7:
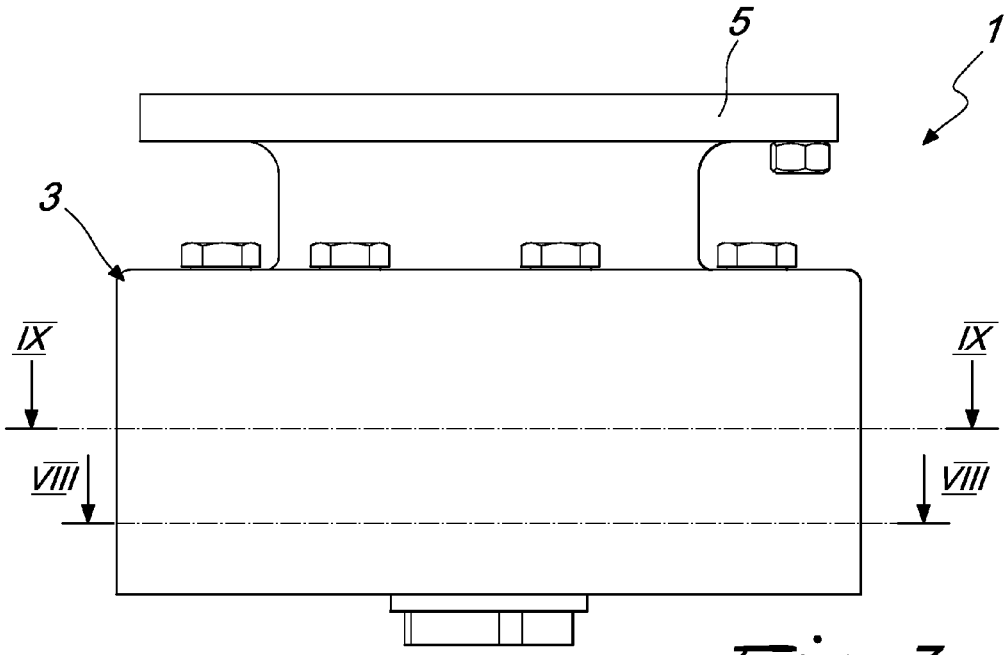
FIG. 7 is a lateral elevation view of the device according to the disclosure.

More particularly, as shown for example in FIG. 2, the first supporting element 2 can be coupled, by adapted connecting means constituted for example by one or more threaded elements 2*a*, to a connecting body 2*b*, which protrudes downward from the first supporting element 2 for its connection to the load cell.

In turn, the second supporting element 3 is assigned to supporting a respective container 4 that is intended to be filled with a product in powder form by the filling machine More particularly, a plate 5 is for example mounted on the second supporting element 3 and a respective container 4 is designed to be rested thereon.

Advantageously, as shown in FIGS. 1 and 2, a clamp can be connected to the plate 5 in a manner known per se and is provided for example with a pair of elastically loaded levers 5*a*, 5*b*, which extend laterally around the container 4, so as to keep it rested on the plate 5.

Moreover, actuation means are associated with the device according to the disclosure and allow actuating, with a vibrating motion, the second supporting element 3 with respect to the first supporting element 2, so as to avoid the accumulation of the product in powder form spilled into the container 4 in a single region of said container.

According to the disclosure, the second supporting element 3 can rotate with respect to the first supporting element 3 about a substantially vertical rotation axis 6.

Also according to the disclosure, the actuation means comprise means 7 for generating a variable magnetic field, which are integral with one of the supporting elements, preferably with the first supporting element 2, as well as magnetic means, which are integral with the other supporting element, preferably with the second support element 3, and are intended to interact with the generator means 7 to generate an alternating oscillation, in the two opposite directions of rotation, of the second supporting element 3 with respect to the first supporting element 2 about the rotation axis 6.

Figure 11:
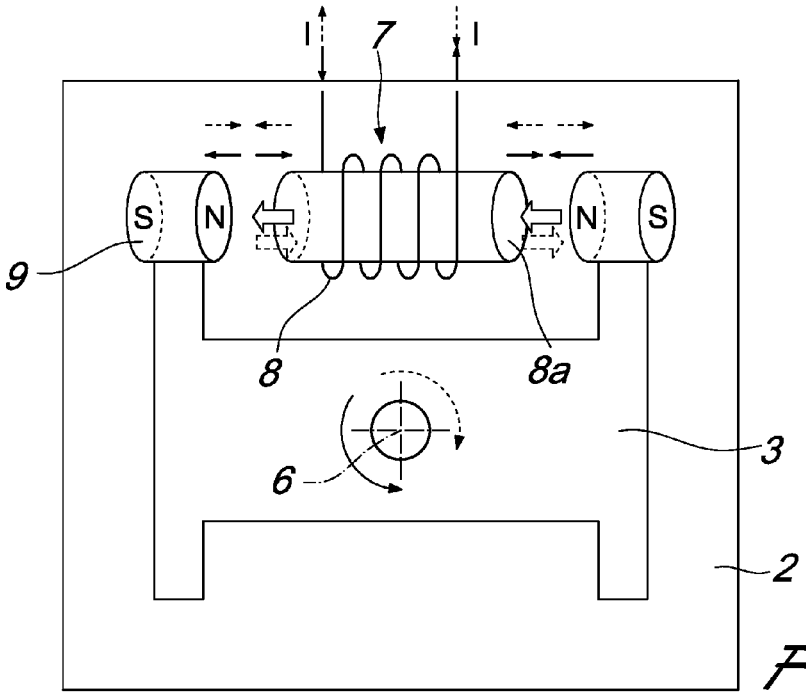
FIGS. 11 to 15 are schematic top views of different possible embodiments of the device according to the disclosure.
Figure 12:
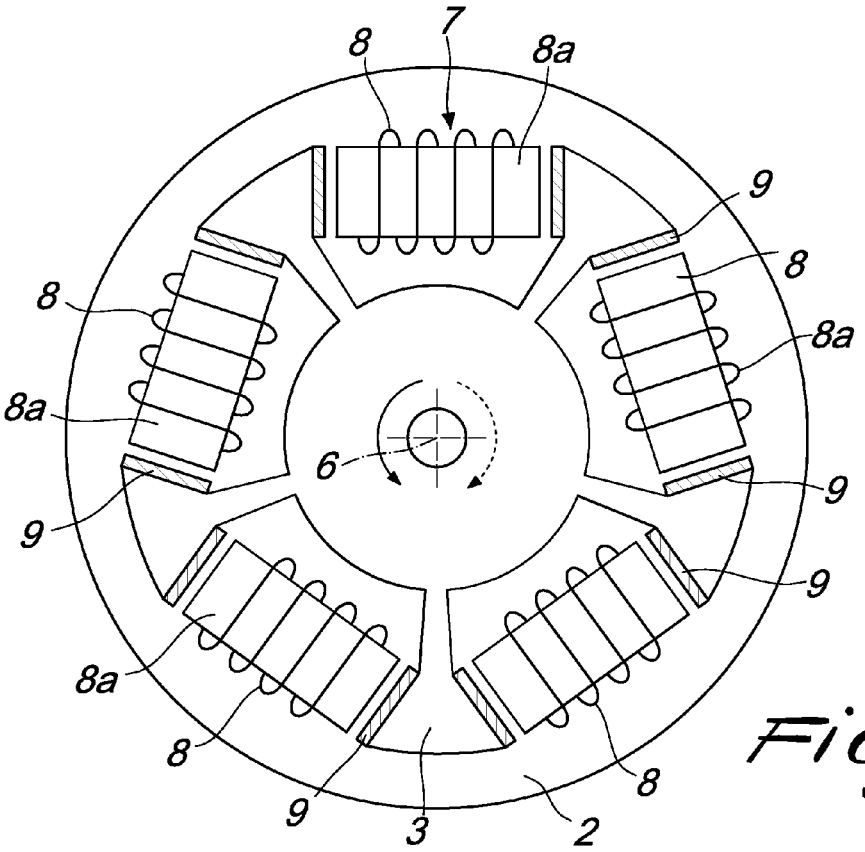

More precisely, according to a first very simple embodiment, shown schematically in FIG. 11, the generator means 7 are constituted advantageously by a solenoid 8, which is designed to be supplied by means of an electric current, and by means for reversing the direction of the electric current that flows through the solenoid 8.

In particular, the solenoid 8 is provided, in a manner known per se, by means of at least one coil of conducting wire, which extends around a winding axis.

Advantageously, the solenoid 8 is spaced radially from the rotation axis 6 and is oriented, with its own axis, substantially horizontally and substantially at right angles to an axis that is directed radially with respect to the rotation axis 6.

Coaxially with the solenoid 8, optionally a core 8*a* is provided, made of ferromagnetic material such as ferrite or other similar material, which allows increasing the magnetic efficiency of the solenoid 8.

Conveniently, the magnetic means in turn comprise at least one permanent magnet 9, which is arranged so as to face, with one of its own poles, a respective axial end of the solenoid 8.

More preferably, the magnetic means comprise at least two permanent magnets 9, each of which faces, with the same pole, a respective end of the solenoid 8.

Optionally, the permanent magnets or magnets 9 can also be constituted respectively by packs of multiple permanent magnets in order to increase the magnetic field associated with them and accordingly also the performance of the actuation means.

According to a different embodiment, the generator means 7 comprise at least two solenoids 8, which are distributed around the rotation axis 6, as shown schematically merely by way of example in FIGS. 12 to 15.

It should be noted that each one of said solenoids 8 is conveniently spaced radially from the rotation axis 6 and is oriented with its axis substantially horizontally and substantially at right angles to an axis that is directed radially with respect to the rotation axis 6.

In this case, the magnetic means conveniently comprise, for each one of the solenoids 8, at least two permanent magnets 9, each of which faces, with the same pole, a respective axial end of the corresponding solenoid 8.

Figure 13:
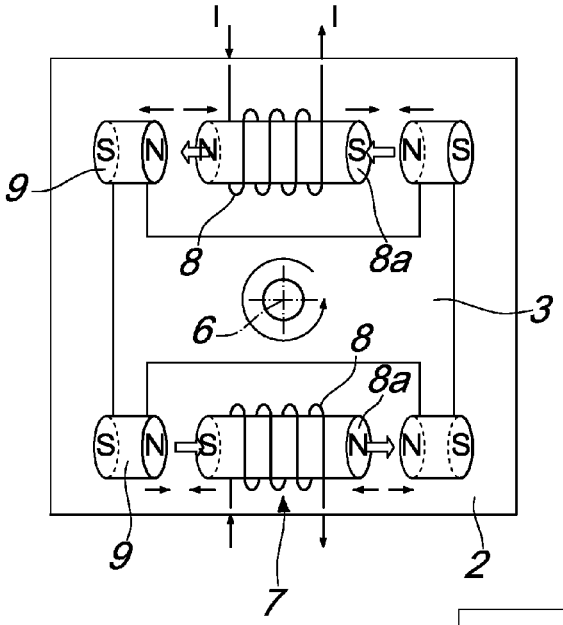
Figure 14:
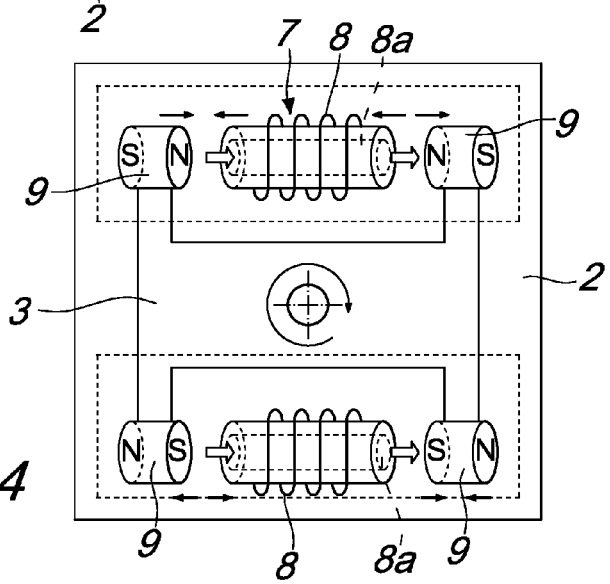
Figure 15:
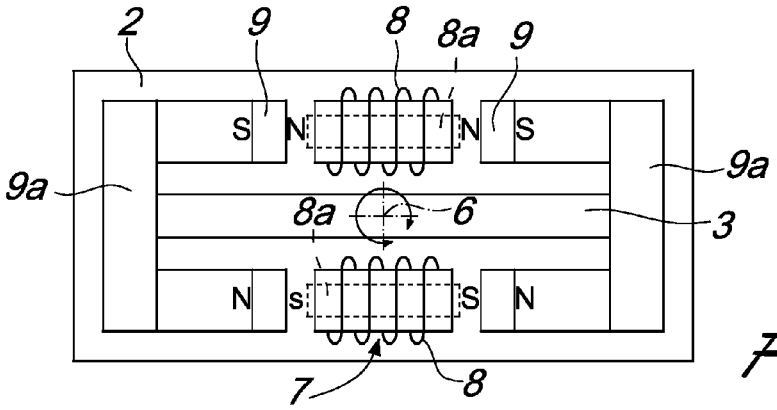

More preferably, according to what is shown schematically in FIGS. 13, 14 and 15, there is at least one pair of solenoids 8, arranged on mutually diametrically opposite sides with respect to the rotation axis 6.

With reference to this particular case, all the permanent magnets 9 that are present might face the axial ends of the various solenoids 8 with the same pole, for example the north pole, as in the diagram shown in FIG. 13.

As an alternative, for one of the solenoids 8 the permanent magnets 9 might face the axial ends of the corresponding solenoid 8 with one of the two poles, for example the north pole, while for the other solenoid 8 of the same pair of solenoids 8 the permanent magnets face the corresponding axial end of the corresponding solenoid 8 with the opposite pole, i.e., the south pole, as shown schematically in FIG. 14 and in FIG. 15.

Moreover, there can be multiple solenoids 8 arranged on different horizontal planes, the ends of each of which can be faced, with a corresponding pole, by one or more permanent magnets 9.

As shown schematically in FIG. 15, it is also possible to insert expansions 9*a* that are integral with the permanent magnets 9, in order to increase the overall magnetic efficiency of the actuation means.

It should be noted that in order to achieve the reversal of the direction of the current, the electric supply of the or of each solenoid 8 is conveniently provided by means of an alternating electric current that has a variable intensity according to a waveform that has a null average value. In particular, the waveform of the electric current can be square, sinusoidal or of any other shape having a null average value, which can be obtained by means of a linear circuit or a switching circuit, of the push-pull type with a half bridge or a full bridge (bridge H).

With reference to the practical embodiment shown in FIGS. 1 to 10, the solenoids 8 are conveniently associated, as mentioned earlier, with the first supporting element 2.

Figure 8:
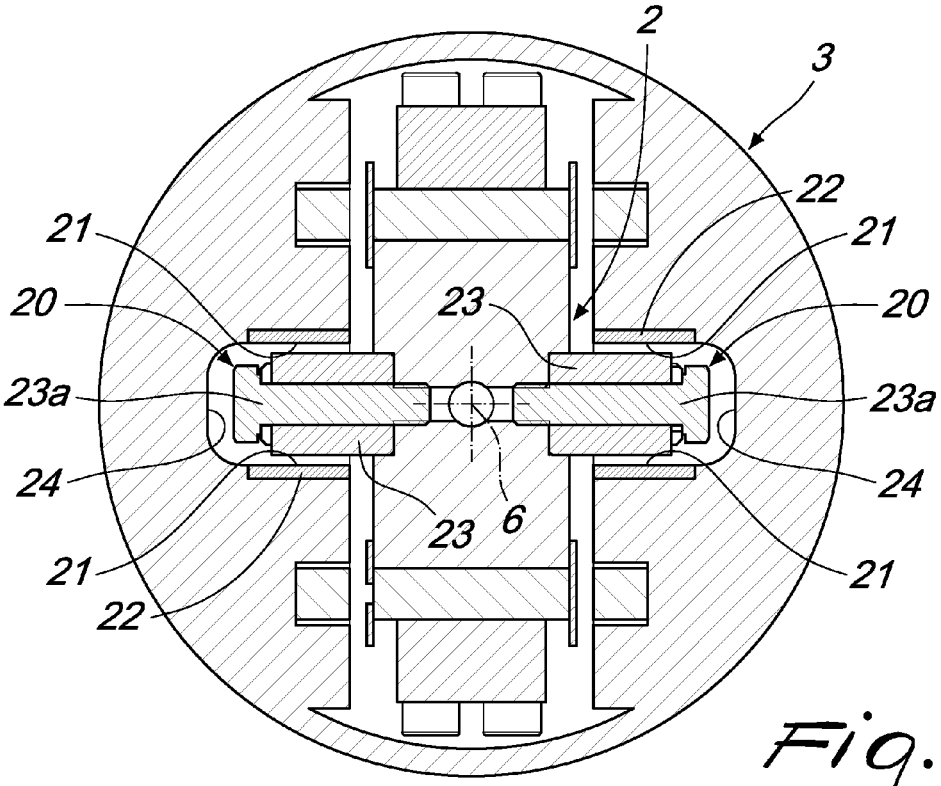
FIG. 8 is a sectional view, along the plane VIII-VIII of FIG. 7.
Figure 9:
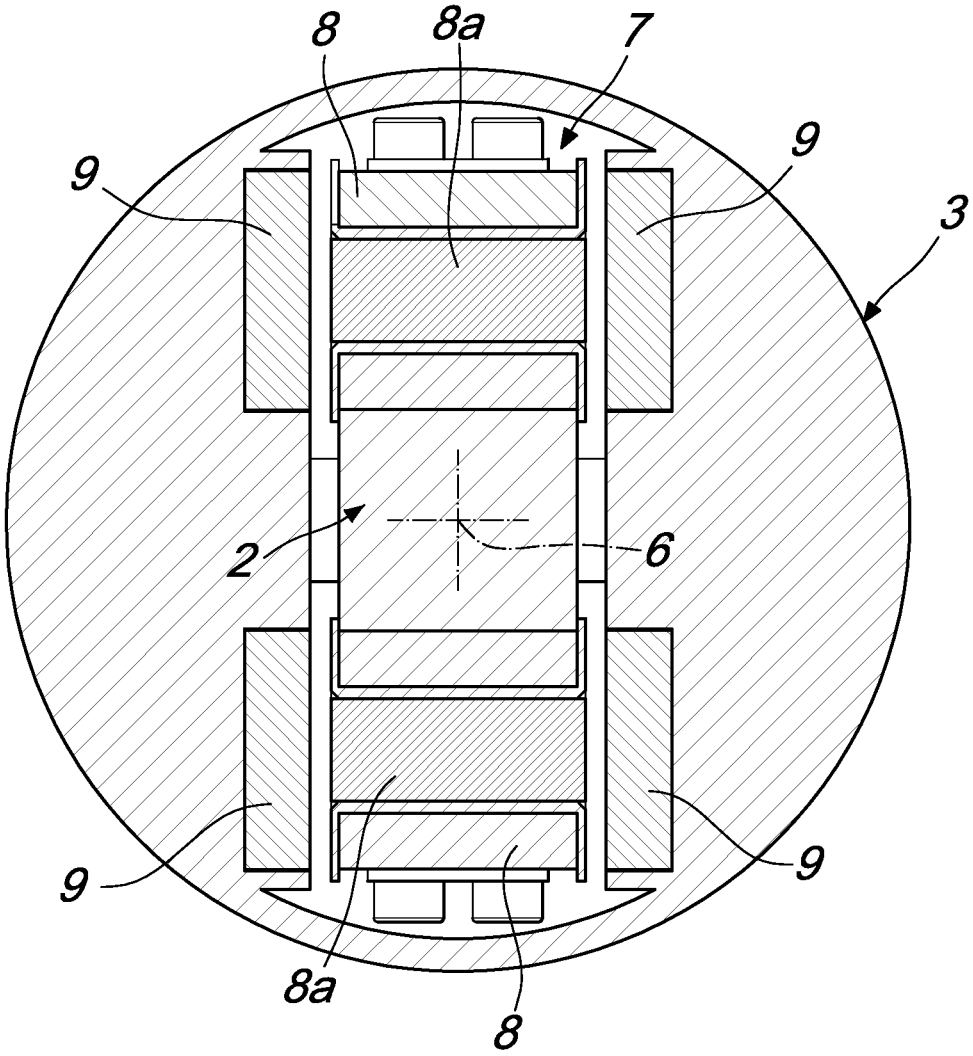
FIG. 9 is a sectional view, along the plane IX-IX of FIG. 8.
Figure 10:
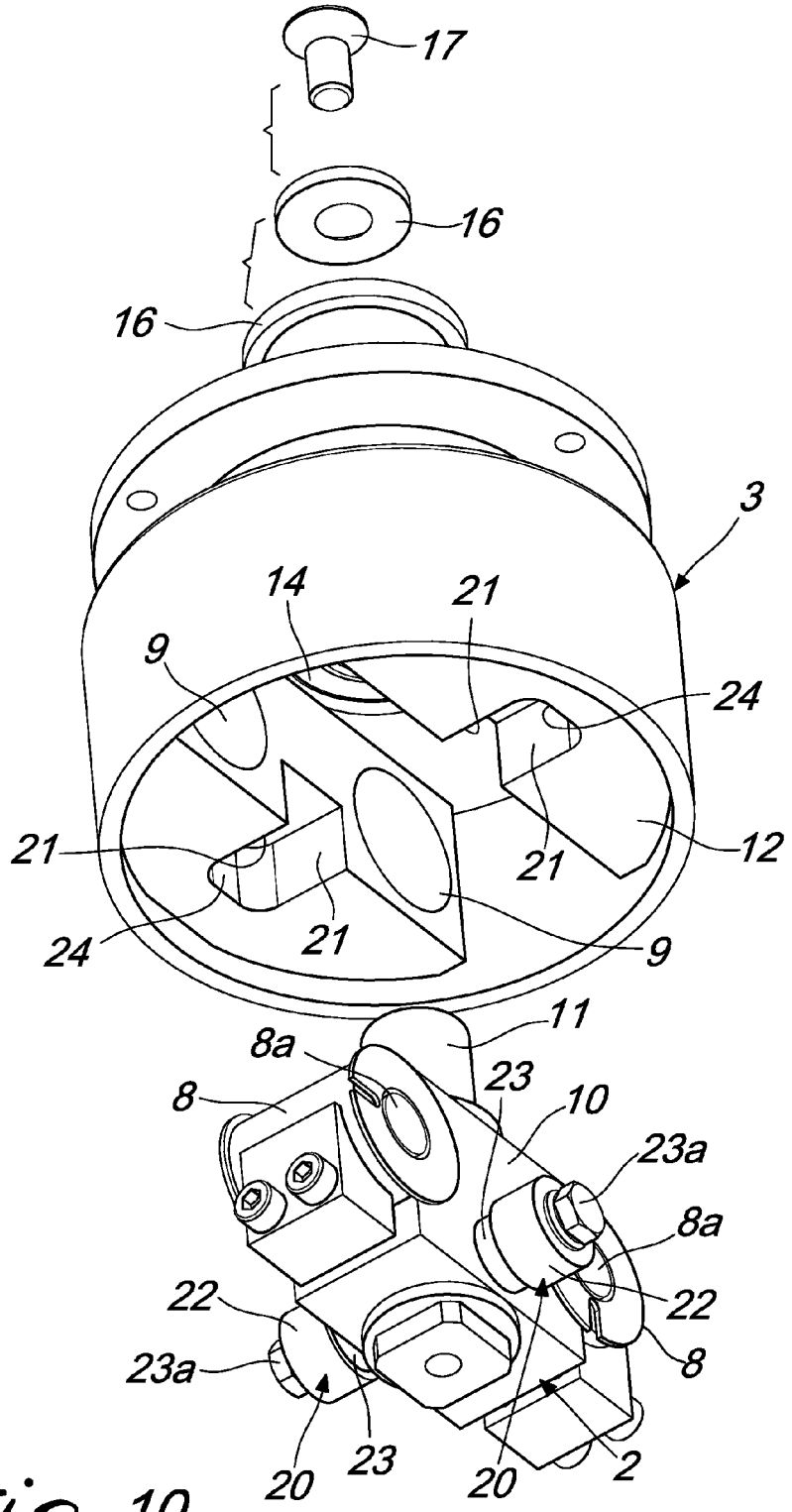
FIG. 10 is an exploded perspective bottom view of the device according to the disclosure.

In particular, as can be seen for example in FIGS. 8, 9 and 10, the first supporting element 2 can be provided by means of a base body 10, which conveniently can have a substantially parallelepipedal elongated shape.

A pivot 11 protrudes upward from the central portion of said base body 10 and forms the rotation axis 6.

Advantageously, respective solenoids 8 are fixed to the opposite longitudinal ends of the base body 10 and are oriented with their respective axes substantially at right angles to the longitudinal extension of the base body 10 and the pivot 11.

Again with reference in particular to FIG. 10, the second supporting element 3 conveniently has a block 12, which has at least one substantially cylindrical portion that has, on its face intended to be directed downward, a receptacle 13 that is shaped so as to correspond to the base body 10.

The permanent magnets 9 are recessed in the opposite longitudinal walls of the receptacle 13 and are intended to face the axial ends of the solenoids 8 supported by the base body 10 of the first supporting element 2.

Moreover, coaxially with the block 12 a rotation seat 14 is formed, intended to accommodate the pivot 11 supported by the base body 10 of the first supporting element 2.

Conveniently, the pivot 11 is coupled to the block 12 in the rotation seat 14 by means of the interposition of bearings 15 that are kept in their seat by assembly rings 16, one of which is integrally associated with the pivot 11 by means of a screw 17.

In order to ensure retention in a substantially stable position of the second supporting element 3 with respect to the first supporting element 2, when the generator means 7 are in the deactivated condition, advantageously there are motion limiting means that operate between the first supporting element 2 and the second supporting element 3.

Conveniently, the limiting means comprise at least one abutment element 20, which is integral with one of the supporting elements, for example with the first supporting element 2, and at least one abutment surface 21, which is formed on the other one of the supporting elements, i.e., according to the example, on the second supporting element 3.

More particularly, the abutment element 20 is interposed advantageously, with a certain play, between a pair of mutually opposite abutment surfaces 21.

According to a preferred embodiment, there is a pair of abutment elements 20 that are arranged on mutually opposite sides with respect to the rotation axis 6 and are each interposed between a respective pair of abutment surfaces 21.

More precisely, each abutment element 20 is conveniently provided by means of a respective protruding pin 23, which protrudes substantially parallel to the axis of the solenoids 8 from a corresponding longitudinal side of the base body 10 of the first supporting element 2.

As shown, each pin 23 can be connected for example to the base body 10 of the first supporting element 2 by means of a respective bolt 23*a* that is coaxial therewith.

Conveniently, the abutment surfaces 21 can be covered by a layer of noise reduction material.

More particularly, as can be seen in particular in FIG. 8, the abutment surfaces 21 of each abutment element 20 can be for example provided by means of a respective bush 22, which is accommodated in a respective recess 24, which is formed in the block 12 of the second supporting element 3 and in turn accommodates internally the corresponding abutment element 20.

Each bush 22 is conveniently made of a plastic material that is adapted to prevent the impact of the abutment elements 20 against it from causing noise.

It should be noted that the abutment elements 20 in practice act, in cooperation with the abutment surfaces 21, also as elements for centering the second supporting element 3 with respect to the first supporting element 2.

The operation of the device according to the disclosure is based in practice, with reference to the embodiments described above, on the interaction between magnetic fields that are constant, in terms of intensity and spatial distribution, and are generated by the permanent magnets 9, and variable magnetic fields, with a null average time value, which however reverse their sign as a consequence of the reversal of the electric current that flows through the solenoids 8 assigned to generating said magnetic fields.

If one considers a single solenoid 8 with two corresponding permanent magnets 9, it can be seen that in view of the orientation of the two permanent magnets 9 the reversal of the current in the corresponding solenoid 8, with the consequent reversal of the direction of the lines of the magnetic field generated by said solenoid 8, causes a reversal of the interaction forces between the solenoid 8 and the permanent magnets 9.

In practice, with the electric current that flows through the solenoid 8 considered in one direction, one of the two permanent magnets 9 is attracted while the other one is repelled. When the direction of the electric current in the solenoid 8 is reversed, the permanent magnet 9 that previously was attracted is repelled, while the permanent magnet 9 that previously was repelled is attracted.

This fact is rendered evident in particular in the drawing of FIG. 11, which shows that in the presence of an electric current flowing through the solenoid 8 according to the arrows drawn in solid lines, a magnetic field is generated in the solenoid which produces repulsion forces, represented by arrows drawn in solid lines, between said solenoid and the permanent magnet 9 that in the drawing is arranged to its left, and attraction forces, again represented by means of arrows with solid lines, between the solenoid 8 and the permanent magnet 9 that in the drawing is arranged to its right. Vice versa, again considering the drawing of FIG. 11, when the electric current flows through the solenoid 8 along the arrows drawn in broken lines, attraction forces, represented by arrows in broken lines, are established between the solenoid 8 and the permanent magnet 9 that in the drawing is arranged to its left, while repulsion forces, as indicated consistently again by arrows in broken lines, are generated between the solenoid 8 and the permanent magnet 9 that is arranged in the drawing to its right.

This alternation of repulsion and attraction forces between the various solenoids 8 and the respective permanent magnets 9 leads to a mechanical motion whose direction is variable over time on the second supporting element 3; such mechanical motion causes, in turn, an alternating oscillation, in the two opposite directions, of the second supporting element 3 with respect to the first supporting element 2 about the rotation axis 6.

It should be noted that the mechanical moment thus generated has an intensity that is a function of the electric current flowing through the solenoids 8, of the intensity of the magnetic field of the permanent magnets 9, of the number of solenoids 8 and of the corresponding permanent magnets 9 that are present in the device according to the disclosure.

It is important to stress that by reversing the direction of the electric current that supplies the various solenoids 8 at a certain frequency, a vibration of the rotating part constituted by the second supporting element 3 is obtained which has the same frequency with which the solenoids 8 are supplied.

During the oscillation of the second supporting element 3 with respect to the first supporting element 2, the abutment elements 20 engage by resting alternately against the corresponding abutment surfaces 21.

In this manner, the motion limiting means allow constraining the overall rotation angle of the second supporting element 3 within a certain variation range and also make it possible, in the inactive condition, in which the solenoids 8 are not powered electrically, to keep the permanent magnets 9 in a position that is substantially symmetrical with respect to the corresponding solenoid 8, so as to optimize magnetic efficiency and block or at least limit the possibility of rotary motion of the second supporting element 3 with respect to the first supporting element 2.

It should be noted that the insertion, within the solenoids 8, of the core of ferromagnetic material 8*a* allows increasing the generated magnetic induction and therefore increases the magnetic interaction of the solenoids 8 with the permanent magnets 9. However, the core made of ferromagnetic material 8*a* increases the equivalent impedance of the solenoids 8, reducing the maximum frequency value that can be applied to the variable electric current that supplies the solenoids 8.

It should also be pointed out that if the solenoids 8 are supplied with an alternating current with a null average value with a duration of the negative part equal to the duration of the positive part, a moment that can vary between positive and negative values that are exactly symmetrical is generated on the second supporting element 3, i.e., the right-handed moment values are equal and opposite to the left-handed moment values that occur on the second supporting element 3.

If the intensity of the positive current is different from that of the negative current, the resulting right-handed and left-handed moment values are instead asymmetrical.

Furthermore, by varying the waveform of the electric current that supplies the solenoids 8 it is possible to obtain different types of vibration.

In particular, with a sinusoidal waveform one obtains the classic vibration of resonant systems, where in a resonance condition the maximum amplitude of the vibration is achieved with the minimum consumption of electric power.

With a waveform in which both fronts are steep, a vibration of the symmetrical pulsed type is obtained.

With a waveform having a single steep front, for example a sawtooth waveform, a vibration with asymmetrical accelerations, typical for example of a pulsed screwdriver or the like, is obtained.

In practice it has been found that the device according to the disclosure achieves fully the intended aim and objects, and in particular the fact is stressed that the device according to the disclosure not only makes it possible to avoid the accumulation of dust during the filling of the containers but also allows automatic filling of the containers with precise real-time control of the weight of the product inserted in the containers, since thanks to the fact that it produces vibrations of a rotary type on the plate that supports the containers it interferes in an absolutely negligible manner, if at all, with the measurement of the weight of the powder introduced in the containers by the load cells of the filling machine It should also be pointed out that the extreme ease with which it is possible to vary the vibration frequency by simply varying the frequency of the electric current that powers the solenoids allows setting said frequency value so as to generate the vibration with a frequency that corresponds to the mechanical resonance frequency of the set constituted by the plate, the supporting device, the container and the product, achieving maximum efficiency.

Furthermore, by providing automatic control with feedback of the device according to the disclosure it is possible to adjust in real time the vibration frequency in order to obtain the maximum effect with the minimum energy expenditure.

Another advantage of the device according to the disclosure is that thanks to the interaction between one or more solenoids supplied with an alternating electric current and permanent magnets it is easy to also vary the energy of the vibration simply by varying the intensity of the alternating electric current that flows through the solenoids, thus optimizing the electric power expended to cause the vibration.

Another advantage of the device according to the disclosure is that it does not have antagonist elastic elements, which over time might lose their original mechanical characteristics, but only the above-cited motion limiting means, which in practice limit the angle of rotation about a substantially stable central position, ensuring a permanence of the characteristics that is assuredly better than in the solution that uses antagonist elastic elements, which furthermore would limit greatly the possibility of varying the vibration frequency.

It should also be noted that the absence of mechanical and elastic antagonist elements ensures a high stability of the device over time and as the temperature varies.

Among the additional advantages of the disclosure that deserve to be noted, there is also the high electromagnetic performance that can be achieved thanks to the operation of a solenoid with respect to two permanent magnets and the fact that the possibility of inserting ferromagnetic material, such as ferrite or the like, within the solenoids allows extending the vibration frequency well beyond the values that can be achieved with soft iron expansions, silicon laminae or the like.

Another advantage of the disclosure that can be mentioned is the absence, in the described embodiments, of poles having a particular shape, as in motors or the like, with a consequent constructive simplification.

Moreover, another advantage of the disclosure is that it does not cause transverse forces with respect to the rotation axis, with a consequent reduction of wear phenomena affecting the bearings of the rotation pivot between the two supporting elements.

All the characteristics of the disclosure described above as advantageous, convenient or the like may also be omitted or be replaced with equivalents.

The individual characteristics presented with reference to general teachings or particular embodiments may all be present in other embodiments or may replace characteristics in these embodiments.

The disclosure thus conceived is susceptible of numerous modifications and variations.

Thus, for example, the described permanent magnets might optionally be replaced with electromagnets with a fixed magnetic field or with a variable magnetic field, which is synchronous with the field of the corresponding solenoid, changing nothing from the conceptual standpoint.

In practice, the materials used, so long as they are compatible with the specific use, as well as the dimensions and shapes, may be any according to the requirements.

All the details may furthermore be replaced with other technically equivalent elements.

The disclosures in Italian Patent Application No. VR2012A000210 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A device for supporting containers in filling machines for products in powder form or the like, comprising:

at least two supporting elements which are mutually coupled, respectively a first supporting element, which is connected to a structure of a filling machine, and a second supporting element, which is rotatably hinged onto said first supporting element and can move with respect to said first supporting element, wherein the second supporting element is configured to support a respective container to be filled, actuation means adapted to actuate with a vibrating motion said second supporting element with respect to said first supporting element, wherein said second supporting element can rotate with respect to said first supporting element about a vertical rotation axis which is vertical with respect to the floor of the filling machine, and wherein said actuation means comprise means for generating a variable magnetic field, which are integral with one of said supporting elements, and magnetic means, which are integral with the other supporting element and interact with said means generating a variable magnetic field in order to cause an alternating oscillation, in the two opposite rotation directions, of said second supporting element with respect to said first supporting element, about said rotation axis.

2. The supporting device according to claim 1, wherein said generator means comprise at least one solenoid powered by an electric current and means for reversing the direction of the electric current that flows through said at least one solenoid.

3. The supporting device according to claim 2, wherein said magnetic means comprise at least one permanent magnet that faces with one of its poles a respective axial end of said at least one solenoid.

4. The supporting device according to claim 1, wherein said magnetic means comprise at least one electromagnet.

5. The supporting device according to claim 1, wherein said magnetic means comprise at least two permanent magnets, each of which faces, with one of its poles, a respective end of said at least one solenoid.

6. The supporting device according to claim 2, wherein said at least one solenoid is arranged so as to be spaced radially from said rotation axis and is oriented with its own axis substantially horizontally and substantially at right angles to an axis that is directed radially with respect to said rotation axis.

7. The supporting device according to claim 2, wherein said generator means comprise at least two solenoids which are arranged around said rotation axis.

8. The supporting device according to claim 2, wherein said magnetic means comprise, for each one of said solenoids, at least two permanent magnets, each of which faces, with the same pole, a respective axial end of the corresponding solenoid.

9. The supporting device according to claim 2, further comprising at least one pair of solenoids which are arranged on diametrically mutually opposite sides with respect to said rotation axis.

10. The supporting device according to claim 1, further comprising motion limiting means adapted to keep said second supporting element in a stable position with respect to said first supporting element, with said generator means in the deactivated condition.

11. The supporting device according to claim 10, wherein said motion limiting means comprise at least one abutment element, which is integral with one of said supporting elements, and at least one abutment surface for said at least one abutment element, formed on the other one of said supporting elements.

* * * * *